US006248495B1

(12) United States Patent
Inokuchi et al.

(10) Patent No.: US 6,248,495 B1
(45) Date of Patent: Jun. 19, 2001

(54) ELECTROSTATIC IMAGE DEVELOPER

(75) Inventors: Yoshinori Inokuchi, Gunma-ken; Takaaki Shimizu; Masaki Tanaka, both of Tokyo, all of (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 09/518,647

(22) Filed: Mar. 3, 2000

(30) Foreign Application Priority Data

Mar. 5, 1999 (JP) ..... 11-058285

(51) Int. Cl.[7] ..... G03G 9/097
(52) U.S. Cl. ..... 430/110
(58) Field of Search ..... 430/110, 137

(56) References Cited

U.S. PATENT DOCUMENTS 5,774,771 * 6/1998 Kukimoto et al. ..... 430/109
5,827,632 * 10/1998 Inaba et al. ..... 430/110
5,840,457 * 11/1998 Urawa et al. ..... 430/111
6,054,244 * 4/2000 Kato et al. ..... 430/111

FOREIGN PATENT DOCUMENTS 2-188421 * 7/1990 (JP) .

OTHER PUBLICATIONS

Derwent Acc No. 1990–266111.*
Grant, Roger et al.. Chemical Dictionary. New York: McGraw–Hill, Inc. p. 531, 1987.*

* cited by examiner

*Primary Examiner*—Christopher Rodee
(74) *Attorney, Agent, or Firm*—Birch, Stewart, Kolasch & Birch, LLP

(57) ABSTRACT

Amorphous spherical silica microparticulates having a specific surface area of 5–50 $m^2/g$ and a particle size distribution of 5–1,000 nm are added to toner particles to form an electrostatic image developer which has improved fluidity and cleaning characteristics. On account of the minimized impurity content of the spherical silica microparticulates, the developer is effective for high-quality and high-speed duplication.

6 Claims, No Drawings

ELECTROSTATIC IMAGE DEVELOPER

This invention relates to an electrostatic image developer for use in the development of electrostatic images in electrophotography and electrostatic recording process.

BACKGROUND OF THE INVENTION

Dry developers used in electrophotography are generally classified into one-component developers using just a toner having a colorant dispersed in a binder resin and two-component developers comprising a toner and a carrier. In effecting duplication using such developers, the developer must be improved in such characteristics as fluidity, anti-caking, fixation, charge acceptance and cleanability in order to be compliant to the process. One common practice for enhancing these characteristics is to add to the toner inorganic microparticulates having a smaller particle size than the toner particles, for example, silica and titania microparticulates.

As the copying speed increases, the recent electrophotographic art places a greater demand for further improvements in fluidity, charging stability and uniformity, and cleanability. Also for better image quality, smaller particle size toners are utilized. However, the smaller particle size toners are poor in powder fluidity than the conventional toners of ordinary particle size and their charging characteristics are readily affected by additives such as external additives. Then a choice of inorganic microparticulates such as silica microparticulates to be added to the toner becomes more important.

Since commonly used silica microparticulates are very fine as demonstrated by a primary particle mean particle size of 10 to 20 nm, they have a strong tendency to agglomerate together and are poorly dispersible, failing to help the toner fully exert fluidity, anti-caking and cleaning characteristics. Silica microparticulates contain impurities which affect the charging characteristics of the toner. If the impurity content of inorganic microparticulates varies between different manufacturing lots, the toner varies in charge quantity, which can cause a significant variation in the density of images developed therewith.

SUMMARY OF THE INVENTION

Therefore, an object of the invention is to provide a novel and improved electrostatic image developer having improved fluidity, anti-caking and cleaning characteristics as well as stable and uniform charging characteristics.

The inventor has found that when amorphous spherical silica microparticulates having a specific surface area of 5 to 50 $m^2/g$ and a particle size distribution of 5 to 1,000 nm are added to toner particles as the inorganic microparticulates, there is obtained an electrostatic image developer which is improved in fluidity, anti-caking and cleaning characteristics and has stable and uniform charging characteristics.

Thus the invention provides an electrostatic image developer comprising amorphous spherical silica microparticulates having a specific surface area of 5 to 50 $m^2/g$ and a particle size distribution of 5 to 1,000 nm.

DESCRIPTION OF THE PREFERRED EMBODIMENTS

According to the invention, the electrostatic image developer is generally defined as comprising toner particles and spherical silica microparticulates added thereto. The toner used herein may be any conventional toner comprising a colorant, a binder resin and optionally, a charge control agent. The binder resin used in the toner may be any of well-known binder resins, for example, homopolymers and copolymers of styrenes such as styrene, chlorostyrene and vinylstyrene; monoolefins such as ethylene, propylene, butylene and isobutyrene; vinyl esters such as vinyl acetate, vinyl propionate, vinyl benzoate, and vinyl butyrate; acrylic or methacrylic esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; vinyl methyl ketone, vinyl hexyl ketone and vinyl isopropenyl ketone. Typical binder resins are polystyrene, styrene-alkyl acrylate copolymers, styrene-acrylonitrile copolymers, styrene-butadiene copolymers, styrene-maleic anhydride copolymers, polyethylene, and polypropylene. Also useful are polyesters, polyurethanes, epoxy resins, silicone resins, polyamides, modified rosin, paraffin and wax.

The colorant used in the toner is not critical. Typical examples include carbon black, Nigrosine dyes, Aniline Blue, Chalcoyl Blue, Chrome Yellow, ultramarine blue, Dupont oil red, quinoline yellow, Methylene Blue chloride, phthalocyanine blue, Malachite Green oxalate, lamp black, and Rose Bengale. The toner powder may also be a magnetic toner powder having magnetic material included therein.

The spherical silica microparticulates used herein are preferably the one described in JP-A 2-188421. Specifically, spherical silica microparticulates are prepared by combustionpyrolysis in flame of an alkoxysilane and/or a partial hydrolytic condensate thereof. The alkoxysilane used herein is represented by the general formula: $R^2{}_aSi(OR^3)_{4-a}$ wherein $R^2$ and $R^3$ are monovalent hydrocarbon groups of 1 to 4 carbon atoms and a is an integer of 0 to 4. Exemplary alkoxysilanes are tetrametoxysilane, tetraethoxysilane, tetrapropoxysilane, tetrabutoxysilane, methyltrimethoxysilane, methyltriethoxysilane, methyltripropoxysilane, methyltributoxysilane, ethyltrimethoxysilane, ethyltriethoxysilane, ethyltripropoxysilane, ethyltributoxysilane, propyltrimethoxysilane, propyltriethoxysilane, butyltrimethoxysilane, butyltriethoxysilane, dimethyldimethoxysilane, dimethyldiethoxysilane, dimethyldipropoxysilane, dimethyldibutoxysilane, diethyldimethoxysilane, diethyldiethoxysilane, diethyldipropoxysilane, diethyldibutoxysilane, dipropyldimethoxysilane, dipropyldiethoxysilane, dibutyldimethoxysilane, dibutyldiethoxysilane, trimethylmethoxysilane, trimethylethoxysilane, trimethylpropoxysilane, trimethylbutoxysilane, triethylmethoxysilane, triethylethoxysilane, triethylpropoxysilane, triethylbutoxysilane, tripropylmethoxysilane, tripropylethoxysilane, tributylmethoxysilane, and tributylethoxysilane, with tetramethoxysilane and methyltrimethoxysilane being especially preferred.

The spherical silica microparticulates used herein should be substantially free of chlorine and have a content of metal impurities other than silicon of up to 5 ppm. If the spherical silica microparticulates contain chlorine or if the content of metal impurities other than silicon exceeds 5 ppm, they can adversely affect the stabilization and consistency of the charging characteristics of the toner. The preferred content of metal impurities other than silicon is up to 1 ppm. Such spherical silica microparticulates of high purity are available using an alkoxysilane which has been purified as by distillation.

Spherical silica microparticulates having a specific surface area of more than 50 $m^2/g$ or a particle size of less than 5 nm are likely to agglomerate, adversely affecting the fluidity, anti-caking and fixation characteristics of the associated developer. Silica microparticulates having a specific surface area of less than 5 $m^2/g$ or a particle size in excess of 1,000 nm can cause alteration and abrasion of the photoconductor, which in turn, exacerbates the adhesion of the toner. For this reason, the spherical silica microparticulates should have a specific surface area of 5 to 50 $m^2/g$ and preferably 10 to 30 $m^2/g$. The particle size distribution should range from 5 nm to 1,000 nm, and preferably from 20 nm to 300 nm.

A method for the preparation of spherical silica microparticulates may follow JP-A 2-188421 as previously mentioned. More particularly, an alkoxysilane and/or a partial hydrolytic condensate is heat evaporated and carried by an inert gas such as nitrogen gas, or sprayed whereupon the vapor or spray is introduced into a flame such as oxyhydrogen flame in which the reactant is subject to combustion pyrolysis. At this point of time, the heat quantity required per unit silica particulate calculated from the total calorific value is set in the range of 1.1 to 1.7 kcal/g. Then spherical silica microparticulates having a specific surface area of 5 to 50 $m^2/g$ and a particle size distribution of 5 to 1,000 nm are obtainable.

For minimizing the variation of the charge quantity with temperature and humidity, the spherical silica microparticulates are preferably hydrophobic spherical silica microparticulates having $R^1{}_3SiO_{1/2}$units introduced to their surface. Herein $R^1$ is independently selected from monovalent hydrocarbon groups of 1 to 6 carbon atoms, for example, methyl, ethyl, propyl, butyl, pentyl, hexyl, cyclohexyl, phenyl, vinyl and allyl groups, with methyl being preferred.

The introduction of $R^1{}_3SiO_{1/2}$units may be achieved in accordance with a well-known method for surface modifying silica microparticulates. More particularly, $R^1{}_3SiO_{1/2}$units can be introduced by contacting silica microparticulates with a silazane compound represented by the general formula: $R^1{}_3SiNHSiR^1{}_3$ in a gas, liquid or solid phase at a temperature of 0 to 400° C. in the presence of water, then heating at a higher temperature of 50 to 400° C. for removing the excess silazane compound.

Examples of the silazane compound represented by the general formula: $R^1{}_3SiNHSiR^1{}_3$ include hexamethyldisilazane, hexaethyldisilazane, hexapropyldisilazane, hexabutyldisilazane, hexapentyldisilazane, hexahexyldisilazane, hexacyclohexyldisilazane, hexaphenyldisilazane, and divinyltetramethyldisilazane. Of these, hexamethyldisilazane is preferred because of hydrophobic properties after modification and ease of its removal.

The electrostatic image developer is obtained by adding the above-described spherical silica microparticulates to toner particles. The amount of the spherical silica microparticulates blended is preferably 0.01 to 20 parts, and more preferably 0.1 to 5 parts by weight per 100 parts by weight of the toner. On this basis, less than 0.01 part of silica microparticulates is ineffective for the toner to become more free-flowing whereas more than 20 parts of silica microparticulates may adversely affect the charging characteristics of the toner. If desired, charge control agents, parting agents, wax and other additives may be blended.

Any desired method may be employed to mix the above ingredients. For example, a V-blender, Henschel mixer, ribbon blender and attritor may be used. The spherical silica microparticulates may be present deposited or fused to surfaces of toner particles.

The electrostatic image developer having spherical silica microparticulates added may be used as a one-component developer or a two-component developer by further mixing the toner with a carrier. When a two-component developer is intended, it is acceptable that spherical silica microparticulates are not previously added to the toner, but added during mixing of the toner with the carrier whereby the toner particles are surface coated therewith. The carrier consists of particles having a particle size approximate to the toner particle size or up to 500 $\mu$m. Exemplary carriers are iron, nickel, cobalt, iron oxide, ferrite, glass beads and particulate silicon, which are well known in the art. Such carrier particles may have been surface coated with fluororesins, acrylic resins, and silicone resins.

The electrostatic image developer of the invention can be used to develop electrostatic images on a photoconductor or electrostatic recording element. More particularly, electrostatic latent images are electrophotographically formed on photoconductors made of inorganic photoconductive materials such as selenium, zinc oxide, cadmium sulfide and amorphous silicon, or organic photoconductive materials such as phthalocyanine pigments and bis-azo pigments. Alternatively, electrostatic latent images are formed on electrostatic recording elements having polyethylene terephthalate derivatives using a needle electrode. Using a developing method such as magnetic brush, cascade or touch-down method, the electrostatic image developer of the invention is applied to the electrostatic latent image, allowing the toner to adhere thereto.

The toner image is transferred and fixed to a transfer element such as paper, giving a copy. The residual toner on the surface of the photoconductor or electrostatic recording element can be cleaned by a blade, brush, web or roll method.

EXAMPLE

Examples of the invention are given below by way of illustration and not by way of limitation.

Example 1

Methyltrimethoxysilane which had been purified by distillation was heated and nitrogen gas was bubbled therein. In this way, methyltrimethoxysilane was carried by nitrogen gas into an oxyhydrogen flame burner whereupon the silane was subject to combustion pyrolysis in the oxyhydrogen flame. At this point of time, the flow rate of methyltrimethoxysilane was 1,268 g/hr, the flow rate of oxygen gas was 2.8 $Nm^3/hr$, the flow rate of hydrogen gas was 2.0 $Nm^3/hr$, the flow rate of nitrogen gas was 0.59 $Nm^3/hr$, and the spherical silica microparticulates received heat at a calorific value of 1.28 kcal/g. The spherical silica microparticulates formed were collected by a bag filter. A 5-liter planetary mixer was charged with 1 kg of the spherical silica microparticulates, and 10 g of pure water was added with stirring. After the mixer was closed, agitation was continued at $_{60°}$ C. for 10 hours. The contents were cooled to room temperature, and 20 g of hexamethyldisilazane was added with stirring. After the mixer was closed, agitation was continued again for 24 hours. The residual reactants and ammonia formed were removed by heating at 120° C. and passing nitrogen gas. This yielded hydrophobic spherical silica microparticulates.

The hydrophobic spherical silica microparticulates were measured for BET specific surface area by means of Micrometerix 2200 (Shimadzu Mfg. K.K.) and examined for particle size distribution under a transmission electron microscope. The results are shown in Table 2. The chlorine content in the hydrophobic spherical silica microparticulates was measured by ion chromatography. The contents of sodium, magnesium, potassium, aluminum, chromium, copper, iron, manganese and nickel were measured by polarization Zeeman flameless atomic absorption spectrometry, the content of titanium measured by an ICP emission spectrophotometer, and the content of uranium measured by a fluorescent spectrophotometer. The results are shown in Table 1.

TABLE 1

| | Impurity contents in hydrophobic spherical silica (ppb) | | | | | | | | | | | |
|---|---|---|---|---|---|---|---|---|---|---|---|---|
| EX 1 | Cl | Na | Mg | Ca | Al | Cr | Cu | Fe | Mn | Ni | Ti | U |
| | 100> | 70 | 50 | 100 | 50 | 20> | 20> | 170 | 10> | 300> | 40> | 0.1> |

Next, 4 parts by weight of Carmine 6BC as a colorant was added to 96 parts by weight of a polyester resin having a Tg of 60° C. and a softening point of 110° C., which was melt mixed, ground, and classified, obtaining a toner having a mean particle size of 7 $\mu$m. In a sand mill, 40 g of the toner was mixed with 1 g of the hydrophobic spherical silica microparticulates to yield a developer. The developer was examined for fluidity and cleanability, with the results shown in Table 2.

Examples 2 and 3

Hydrophobic spherical silica microparticulates were obtained by the same procedure as in Example 1 except that the flow rates of methyltrimethoxysilane, oxygen gas, hydrogen gas and nitrogen gas, and the heat quantity that the spherical silica microparticulates received were changed as shown in Table 2. The BET specific surface area and particle size distribution of the hydrophobic spherical silica microparticulates were measured, with the results shown in Table 2.

By following the procedure of Example 1, developers were prepared. The fluidity and cleanability of the developers were examined, with the results shown in Table 2.

Example 4

Hydrophobic spherical silica microparticulates were obtained by the same procedure as in Example 1 except that tetramethoxysilane was used instead of methyltrimethoxysilane, the flow rates of silane, oxygen gas, hydrogen gas and nitrogen gas, and the heat quantity that the spherical silica microparticulates received were changed as shown in Table 2. The BET specific surface area and particle size distribution of the hydrophobic spherical silica microparticulates were measured, with the results shown in Table 2.

By following the procedure of Example 1, a developer was prepared. The fluidity and cleanability of the developer were examined, with the results shown in Table 2.

Example 5

Methyltrimethoxysilane which had been purified by distillation was heated and nitrogen gas was bubbled therein. By carrying methyltrimethoxysilane by nitrogen gas into an oxyhydrogen flame burner and feeding pure water through a spray nozzle, the silane was subjected to combustion pyrolysis in the oxyhydrogen flame. At this point of time, the flow rate of methyltrimethoxysilane was 1,268 g/hr, the flow rate of oxygen gas was 2.8 $Nm^3$/hr, the flow rate of hydrogen gas was 2.0 $Nm^3$/hr, the flow rate of nitrogen gas was 0.59 $Nm^3$/hr, the flow rate of pure water was 5.6 g/hr, and the spherical silica microparticulates received heat at a calorific value of 1.28 kcal/g. From a spray nozzle, hexamethyldisilazane was sprayed at a feed rate of 11.2 g/hr over the spherical silica microparticulates formed, which were collected by a bag filter. The inlet to the nozzle for hexamethyldisilazane was at a temperature of 300° C. The BET specific surface area and particle size distribution of the hydrophobic spherical silica microparticulates were measured, with the results shown in Table 2.

By following the procedure of Example 1, a developer was prepared. The fluidity and cleanability of the developer were examined, with the results shown in Table 2.

Comparative Example

Hydrophobic spherical silica microparticulates were obtained by the same procedure as in Example 1 except that the flow rates of methyltrimethoxysilane, oxygen gas, hydrogen gas and nitrogen gas, and the heat quantity that the spherical silica microparticulates received were changed as shown in Table 2. The BET specific surface area and particle size distribution of the hydrophobic spherical silica microparticulates were measured, with the results shown in Table 2.

By following the procedure of Example 1, a developer was prepared. The fluidity and cleanability of the developer were examined, with the results shown in Table 2.

Fluidity Test

The fluidity was examined by measuring a cohesiveness. The developer, 5 g, was placed on top of a screen assembly of vertically stacked 60, 100 and 200-mesh screens. Using a powder tester (by Hosokawa Micron K.K.), the screen assembly was vibrated over a stroke of 1 mm for 15 seconds. The weight (a in gram) of a powder fraction on the 60-mesh screen, the weight (b in gram) of a powder fraction on the 100-mesh screen, and the weight (c in gram) of a powder fraction on the 200-mesh screen were determined. From these weights, the cohesiveness was calculated according to the following equation.

$$\text{Cohesiveness } (\%)=(a+b\times 0.6+c\times 0.2)\times 100/5$$

The lower the cohesiveness, the better becomes the fluidity.

Cleanability

A developer as prepared above was mixed with a carrier in the form of ferrite cores of 50 $\mu$m in mean particle size coated with a polyblend of a perfluoroalkyl acrylate resin and an acrylic resin, giving a two-component developer. In a printer equipped with an organic photoconductor, the two-component developer was admitted into a modified developing unit. A printing test of 30,000 sheets was carried out. The adhesion of the toner to the photoconductor appeared as white spots in the whole solid image.

TABLE 2

| | E1 | E2 | E3 | E4 | E5 | CE |
|---|---|---|---|---|---|---|
| Type of alkoxysilane | Methyl-trimethoxy-silane | Methyl-trimethoxy-silane | Methyl-trimethoxy-silane | Tetramethoxy-silane | Methyl-trimethoxy-silane | Methyl-trimethoxy-silane |
| Alkoxysilane flow rate (g/hr) | 1268 | 1655 | 1478 | 1199 | 1268 | 1214 |
| Oxygen gas flow rate ($Nm^3$/hr) | 2.8 | 2.8 | 2.6 | 3.3 | 2.8 | 2.3 |
| Hydrogen gas flow rate ($Nm^3$/hr) | 2.0 | 2.0 | 2.0 | 4.5 | 2.0 | 2.0 |
| Nitrogen gas flow rate ($Nm^3$/hr) | 0.59 | 0.59 | 0.16 | 1.03 | 0.59 | 4.8 |
| Heat quantity to microperticulates (kcal/g) | 1.28 | 1.40 | 1.49 | 1.25 | 1.28 | 0.80 |
| BET specific surface area ($m^2$/g) | 23.3 | 18.4 | 15.3 | 25.3 | 23.0 | 60.6 |
| Particle size distribution (nm) | 20–250 | 20–200 | 20–150 | 50–300 | 20–250 | 1–100 |
| Fluidity (cohesiveness %) | 3 | 5 | 6 | 3 | 3 | 40 |
| Cleanability | no white spots | no white spots | no white spots | no white spots | no white spots | white spots |

There has been described an electrostatic image developer comprising spherical silica microparticulates with specific parameters, which has improved fluidity and cleaning characteristics. Since the spherical silica microparticulates' content of impurities which can affect charging characteristics is minimized, the developer is effective for high-quality and high-speed duplication.

Japanese Patent Application No. 11-058285 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. an electrostatic image developer comprising amorphous spherical silica microparticulates having a specific surface area of 5 to 50 $m^2$/g and a particle size of 5 to 1,000 nm, being substantially free of chlorine and having a content of metal impurities of up to 5 ppm.

2. The electrostatic image developer of claim 1 wherein the spherical silica microparticulates have been prepared by combustion pyrolysis in flame of an alkoxysilane, a partial hydrolytic condensate thereof or both with the heat quantity required per unit silica particulate calculated from the total calorific value being set in the range of 1.1 to 1.7 kcal/g.

3. The electrostatic image developer of claim 1 wherein the spherical silica microparticulates are hydrophobic spherical silica microparticulates having $R^1{}_3SiO_{1/2}$units introduced to their surface wherein $R^1$ is independently a monovalent hydrocarbon group of 1 to 6 carbon atoms.

4. The electrostatic image developer of claim 1, said spherical silica microparticulates having a particle size of 20 nm to 300 nm.

5. The electrostatic image developer of claim 1, said spherical silica microparticulates having a specific surface area of 10 to 30 $m^2$/g.

6. The electrostatic image developer of claim 1, said spherical silica microparticulates having a content of metal impurities of up to 1 ppm.

* * * * *